United States Patent [19]

Hook

[11] 4,046,601

[45] Sept. 6, 1977

[54] METHOD OF NITRIDE-STRENGTHENING LOW CARBON STEEL ARTICLES

[75] Inventor: Rollin E. Hook, Dayton, Ohio

[73] Assignee: Armco Steel Corporation, Middletown, Ohio

[21] Appl. No.: 691,245

[22] Filed: June 1, 1976

[51] Int. Cl.[2] ..... C21D 1/48

[52] U.S. Cl. ..... 148/15; 148/20; 148/36; 148/16.6

[58] Field of Search ..... 148/15.5, 15.0, 16.0, 148/16.6, 18, 20, 20.3, 20.6, 12.1, 36

[56] References Cited

U.S. PATENT DOCUMENTS

| | | | |
|---|---|---|---|
| 3,194,696 | 7/1965 | Muller | 148/15.5 |
| 3,615,904 | 10/1971 | Kindlimann | 148/12.1 |
| 3,847,682 | 11/1974 | Hook | 148/12.1 |
| 3,928,087 | 12/1975 | Hook | 148/36 |

*Primary Examiner*—Walter R. Satterfield

*Attorney, Agent, or Firm*—Melville, Strasser, Foster & Hoffman

[57] ABSTRACT

A method for internal strengthening of articles formed from deep drawing quality low carbon steel strip or sheet containing about 0.02 to about 0.3% titanium in solution, up to about 0.3% columbium in solution, columbium when present being in an amount of at least 0.025% in solution, with the sum total of titanium and columbium in solution not exceeding about 0.3%, comprising the steps of heating the articles at a temperature of about 570° to about 580° C in a nitriding fluid for a time sufficient to form a total nitrogen concentration adjacent the surfaces of the articles at least substantially equal to the amount theoretically required to combine completely with the nitride-forming elements in the steel; and diffusion annealing the articles in a non-nitriding fluid at a temperature of about 595° to about 815° C for a time sufficient to complete through-thickness strengthening by reaction of the nitrogen with the nitride-forming elements. A preferred nitriding fluid is a fused cyanate salt bath.

14 Claims, 5 Drawing Figures

RELATIVE RING HEIGHTS AFTER COMPRESSION TO POINT OF CRACKING, SAMPLES DIFFUSION ANNEALED IN AIR.

RELATIVE RING HEIGHTS AFTER COMPRESSION TO POINT OF CRACKING, SAMPLES DIFFUSION ANNEALED IN DENITRIDING ATMOSPHERE.

METHOD OF NITRIDE-STRENGTHENING LOW CARBON STEEL ARTICLES

BACKGROUND OF THE INVENTION

1. Field of the Invention

The present invention relates to a method of strengthening articles formed from a low carbon, low alloy deep drawing cold rolled and annealed strip and sheet stock which is capable of responding to the strengthening method. In particular, a preferred embodiment of this invention involves the concept of producing stamped or deep drawn parts from a highly formable, low strength, deep drawing-quality steel, and subsequently strengthening the parts after forming by alloy-nitrogen precipitation strengthening. Thus, it is possible to produce high strength, complex stampings which require a highly formable steel to make, which cannot be made from high strength sheet steels because of their low degree of formability relative to deep drawing-quality sheet steels.

2. Description of the Prior Art

U.S. Pat. No. 3,847,682, issued Nov. 12, 1974 to Rollin E. Hook, discloses a method of increasing the yield strength of a low carbon steel sheet stock or an article formed therefrom by heating in an atmosphere comprising ammonia and hydrogen. A deoxidized, low carbon steel containing from about 0.002 to about 0.015% carbon, up to about 0.012% nitrogen, up to about 0.08% aluminum, a nitride-forming element chosen from the group consisting of titanium, columbium, zirconium, and mixtures thereof, in amounts such that titanium in solution is from about 0.02 to about 0.2%, columbium in solution is from about 0.025 to about 0.3%, and zirconium in solution is from about 0.025 to about 0.3%, and balance essentially iron, is heat treated at 1100° to 1350° F in an atmosphere containing ammonia in an amount insufficient, at the temperature and time involved, to permit formation of iron nitride. Within a preferred temperature range of 1100° to 1300° F the preferred furnace atmosphere comprises ammonia-hydrogen mixtures having 3 to 6% by volume ammonia. The maximum ammonia concentrations which can be used within this temperature range and which avoid the formation of an iron nitride surface layer are as follows:

| | |
|---|---|
| 1100° F | about 10% ammonia |
| 1200° F | about 6% ammonia |
| 1300° F | about 3% ammonia |

This patent further discloses that nitrogen taken into solid solution as a result of the alloy-nitrogen precipitation strengthening step can present weldability problems and can result in high ductile-to-brittle Charpy impact transition temperatures. However, if the nitriding step is followed by a denitriding step which involves annealing in pure hydrogen at about 1200° F for at least 2 hours, the excess nitrogen is removed (with only a 10–20% reduction in yield strength), thereby eliminating welding porosity and substantially reducing the ductile-to-brittle transition temperature with consequent improvement in Charpy impact energy values.

Case hardening by heat treating in an ammonia-containing atmosphere to form an iron-nitrogen austenitic structure which is transformed by quenching to a martensitic structure having high surface hardness, has been practiced for many years, and a typical process relating to nitriding of a "Nitralloy" type steel is disclosed in U.S. Pat. No. 3,399,085, issued Aug. 27, 1968 to H. E. Knechtel et al.

U.S. Pat. No. 3,215,567, issued Nov. 2, 1965 to H. Yoshida; U.S. Pat. No. 3,281,286, issued Oct. 25, 1966 to M. Shimizu et al; and U.S. Pat. No. 3,303,060, issued Feb. 7, 1967 to M. Shimizu et al., disclose denitriding and decarburizing of cold-rolled low carbon steel sheet and strip stock. When denitriding is desired in these prior art processes, an atmosphere containing in excess of 70% by volume hydrogen is used (derived from AX or HNS gas) at temperatures ranging from about 600° to about 750° C.

While the above-mentioned U.S. Pat. No. 3,847,682 thus provides a method of strengthening low carbon steel strip or sheet, or articles formed therefrom by stamping or deep drawing, for optimum weldability and Charpy impact properties, the product requires denitriding after the alloy-nitrogen precipitation strengthening step. According to the prior art denitriding must be conducted in an atmosphere containing more than about 70% hydrogen at temperatures of about 700° to about 750° C, for periods of time ranging up to 40 hours. It is thus evident that such a denitriding step is expensive, commercially impractical and dangerous by reason of the high hydrogen content of the annealing atmosphere.

Application Ser. No. 607,624, filed Aug. 25, 1975, in the name of Rollin E. Hook, discloses a method of strengthening deep drawing quality low carbon steel sheet and strip stock, or article formed therefrom, containing from about 0.002 to about 0.015% carbon, up to about 0.012% nitrogen, up to about 0.08% aluminum, about 0.05 to about 0.6% manganese, up to about 0.035% sulfur, up to about 0.01% oxygen, up to about 0.01% phosphorus, up to about 0.015% silicon, a nitride-forming element chosen from the class consisting of titanium, columbium, zirconium, and mixtures thereof, in amounts such that titanium in solution is from about 0.02 to about 0.2%, columbium in solution is from about 0.025 to about 0.3%, and zirconium in solution is from about 0.025 to about 0.3%, the sum total of nitride-forming elements not exceeding about 0.3% in solution, and balance iron. The sheet and strip stock is annealed to produce complete recrystallization; the stock, or article formed therefrom, is then heat treated in an atmosphere comprising about 1 to about 20% by volume ammonia in a carrier gas of nitrogen and hydrogen at 593° to 705° C (1100° to 1300° F) for a period of time sufficient to cause reaction of the nitride-forming elements with ammonia to form small, uniformly dispersed nitrides and to form a surface layer of iron nitride, and denitrided in an atmosphere comprising about 6 to about 50% by volume hydrogen and balance nitrogen at 650° to 760° C (1200° to 1400° F) for a period of time sufficient to remove the iron nitride surface layer and to reduce nitrogen in solid solution to less than about 0.03% by weight. The yield strength is increased to at least about 50 ksi, and an average plastic strain ratio of at least about 1.8 is obtained.

While the strengthening methods disclosed in U.S. Pat. No. 3,847,682 and in application Ser. No. 607,624 achieve excellent properties in the final products, in most instances the heat treatment times extend beyond the range amenable to continuous annealing processes. Ordinarily the strengthening heat treatment for articles must be conducted as a batch type operation wherein the time required to heat the charge of strip, sheet or articles to the heat treatment temperature and the time required to cool the charge back to room temperature would appreciably exceed the time required at the temperature of heat treatment. The total heat treatment time or cycle time, as a measure of production rate, must include the heat-up and cool-down times as well as the time at temperature. Alternative strengthening methods which would substantially reduce the cycle time, would thus provide significant advances in economy of operation through higher production rates and a reduction in the number of heat treating units required to establish a given level of production.

Nitrocarburizing by means of molten cyanide and/or cyanate bath treatments is discussed in articles in "Heat Treatment of Metals", pp. 39–49 and 51–54 (1975). The article by T. Bell, entitled "Ferritic Nitrocarburising", at pp. 39–49 reviews molten salt bath treatments, gaseous nitrocarburizing and vacuum nitrocarburizing. It is indicated that all such treatments, when applied to ferritic steels, result in formation of an epsilon iron carbonitride phase on the surface which improves the tribological properties, fatigue resistance, and wear and anti-scuffing properties. It is stated that during ferritic nitrocarburizing only nitrogen diffuses inwardly from the carbonitride compound surface layer "because the ferrite is normally already at its equilibrium concentration with respect to carbon." With molten salt bath treatment, conducted at 570° C (1060° F) followed by atmosphere cooling, the depth of diffusion, as determined by nitrogen analysis, ranged from about 0.3 mm after 0.1 hour to about 2 mm after 10 hours treatment. A depth of about 1 mm was attained after 2 hours treatment. Gaseous nitrocarburizing obtained substantially identical results.

SUMMARY

It is a principal object of this invention to provide a process for strengthening articles formed from a deep drawing steel sheet or strip of a suitable composition by a nitriding treatment followed by a diffusion annealing treatment, either with or without accompanying denitriding, which is economical and commercially feasible. Furthermore, the method of this invention offers significant advantages over prior art methods. The present method can be practiced on a continuous process basis, and the heat treatment cycle time can be reduced to as little as about one-tenth that required for batch type processing in controlled gas atmospheres. One embodiment of the present method does not involve the employment of controlled or protective atmospheres, leading to lower capital equipment costs and greater economy of operation.

A composition suitable for the practice of the present invention comprises, by weight percent:

| | |
|---|---|
| carbon | about 0.002% – 0.015% |
| nitrogen | up to about 0.012% |
| aluminum | up to about 0.08% |
| manganese | about 0.05% – 0.6% |
| sulfur | up to about 0.035% |
| oxygen | up to about 0.01% |
| phosphorus | up to about 0.01% |
| silicon | up to about 0.015% |
| titanium | about 0.02% – 0.3% in solution |
| columbium | up to about 0.3% in solution |
| iron | remainder, except for incidental impurities. |

When present, columbium is added in an amount of at least about 0.025% in solution, with the sum total of titanium and columbium in solution not exceeding about 0.3%.

According to the present invention, the steel from which the article is to be formed is produced by vacuum decarburizing and deoxidizing a low carbon steel melt, alloying to provide a composition within the broad ranges set forth above, casting the molten steel into ingots or continuously casting to slab form, hot rolling to strip thickness, removing the hot mill oxide scale, cold rolling to strip or sheet thickness, and annealing to obtain a fully recrystallized, ductile deep-drawing steel.

In its broadest aspect the subsequent internal strengthening treatment for articles formed from the cold rolled and annealed steel comprises two heat treatment steps: (1) nitriding at a temperature of about 570° to 580° C in a fluid capable of forming on the surfaces of said article an epsilon iron nitride layer, followed by (2) diffusion annealing in a non-nitriding fluid. The term "fluid" as used herein includes both a fused salt bath and a gaseous atmosphere.

In the preferred practice of the invention, two embodiments (hereinafter referred to as Method I and Method II) of the strengthening treatment may be carried out. In both embodiments the nitriding step is conducted in a fused or molten nitriding salt bath. In Method I the diffusion anneal is conducted in a denitriding controlled atmosphere, whereas in Method II there is no need to denitride during the diffusion annealing step. However, it is a common feature that the diffusion anneal is at all times non-nitriding even though it is additionally denitriding in the case of Method I, and non-denitriding (and optionally non-oxidizing) in Method II.

In the embodiment of Method I nitriding is preferably conducted in a fused cyanate salt bath at a temperature of about 570° to 580° C (1060° to 1075° F) for a period of time, generally proportional to the thickness of the steel sheet from which the articles are formed, sufficient to provide nitrogen diffusion through a substantial portion of the thickness (with diffusion proceeding through both surfaces) in addition to formation of an epsilon iron nitride layer and a total nitrogen concentration exceeding the theoretical nitrogen content which would result from complete reaction of all the nitride formers in the steel (titanium, aluminum and columbium). The articles are then subjected to a combination diffusion and denitriding anneal in a hydrogen and nitrogen atmosphere at about 650° to about 730° C (1200° to 1350° F) for a period of time, dependent on steel thickness, sufficient to complete through-thickness nitrogen-alloy strengthening and simultaneously reduce the level of excess nitrogen in solid solution and as iron nitrides to a preferred level of less than 0.03% by weight.

In the embodiment of Method II the nitriding treatment is conducted for a shorter period of time under otherwise identical conditions, whereby to provide a total nitrogen concentration substantially equal to the amount required to combine completely with the nitride-forming elements in the steel. Alloy-nitrogen strengthening is then effected by means of a diffusion anneal, which is of greater duration than the diffusion-denitriding anneal of Method I. This diffusion anneal is conducted at about 595° to about 815° C (about 1100° to 1500° F), and may be carried out in air, a non-oxidizing and non-denitriding gas atmosphere, or in a neutral (i.e., non-nitriding and non-denitriding) fused salt bath. If annealed in air, a slight surface oxide is formed which is readily removed by conventional means.

The recrystallization anneal given to the cold rollec strip or sheet stock used to form the articles before the internal strengthening treatment, may be conducted as a continuous anneal at a temperature up to about 900° C, or as an open-coil or batch anneal in a hydrogen-nitrogen furnace atmosphere (e.g.) about 6 to about 20% hydrogen by volume) at about 705° to about 788° C for at least about 4 hours.

The thickness of cold rolled strip and sheet stock which may be formed into articles and subjected to the process of this invention ranges from about 0.02 to about 0.10 inch (0.508 to 2.54 mm). Within this thickness range, the nitriding step of Method I is conducted with a time at temperature of about one-quarter to about one hour, and the diffusion and denitriding anneal thereof is conducted with a time at temperature of about ½ to about 2 hours. For Method II the nitriding treatment involves a time at temperature of about 5 minutes to about 1 hour, while the diffusion anneal thereof involves a time at temperature of about 10 minutes to about 3 hours.

BRIEF DESCRIPTION OF THE DRAWINGS

Reference is made to the accompanying drawing wherein:

FIG. 2 is a graphic illustration of through-thickness hardness distributions in a 0.06 inch thick sheet specimen after fused salt nitriding times of 1 to 2 hours;

DESCRIPTION OF THE PREFERRED EMBODIMENTS

Figure 1:
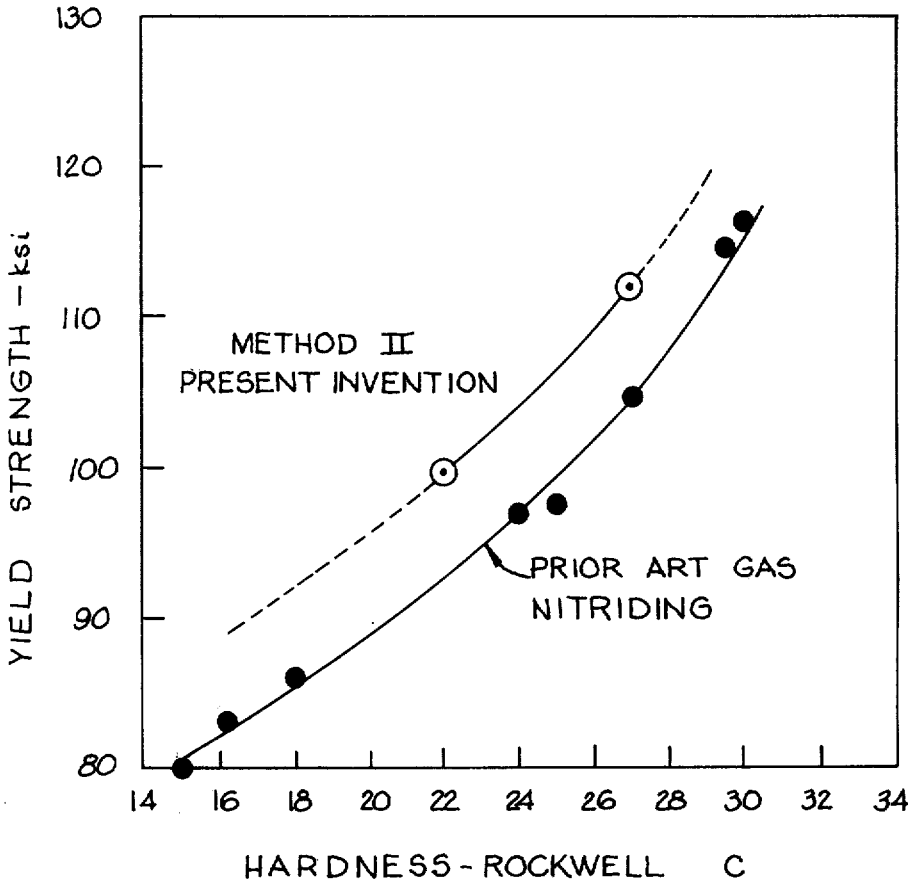
FIG. 1 is a graphic correlation of yield strength with hardness (Rockwell C scale) of a 0.06 inch thick sheet specimen processed in accordance with the present invention and a similar specimen nitrided by a prior art process.
Figure 8:
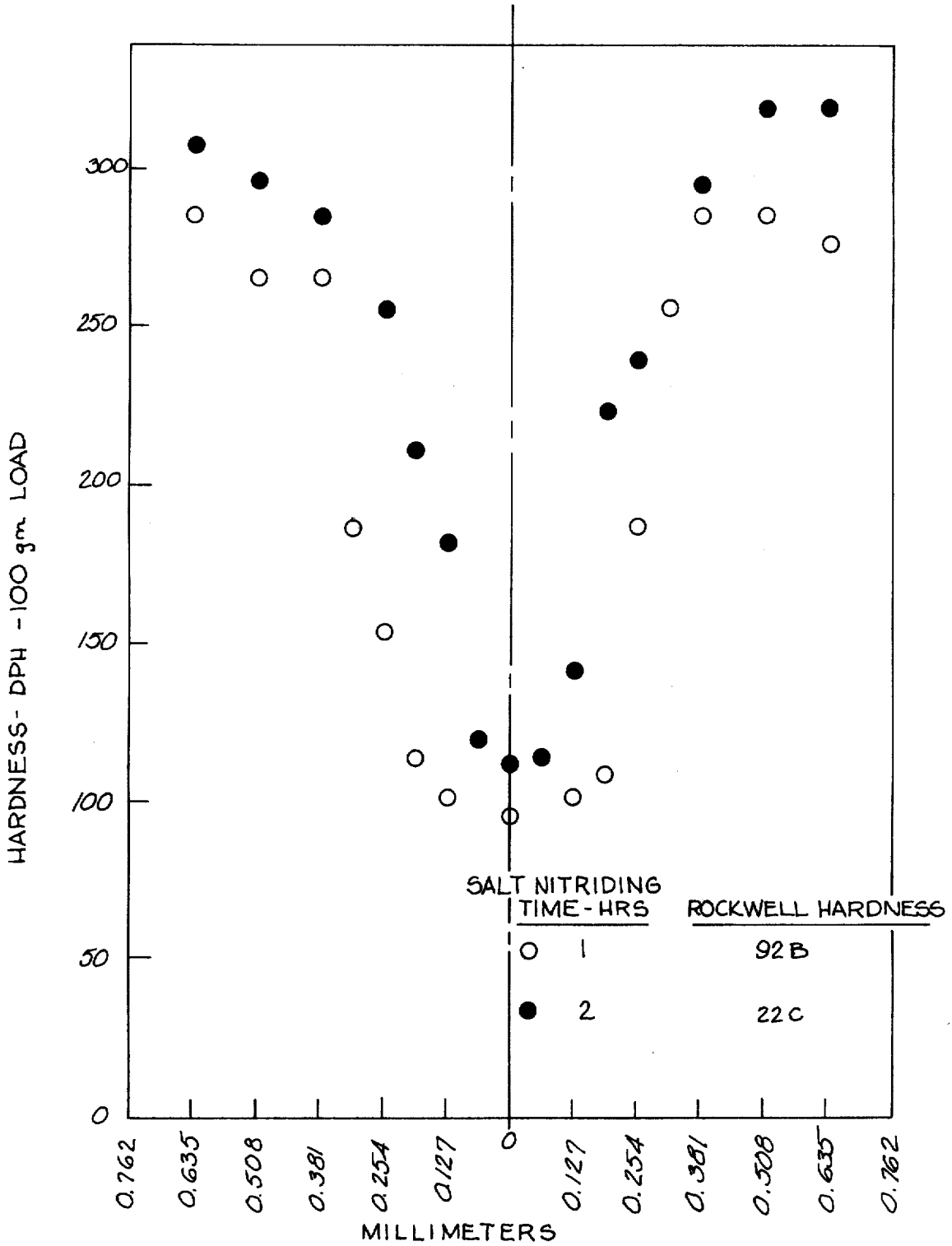

A preferred composition for carrying out the method of the present invention, is as follows, in weight percent:

| | |
|---|---|
| carbon | less than about 0.010% |
| nitrogen | up to about 0.004% |
| aluminum | about 0.02% to 0.06% (total |
| manganese | about 0.05% to about 0.6% |
| sulfur | up to about 0.035% |
| oxygen | up to about 0.01% |
| phosphorus | residual |
| silicon | residual |
| titanium | about 0.05% to 0.15% (total) |
| columbium | about 0.03% to 0.06% (total) |
| iron | balance, except for incidental impurities. |

As in the case of the broad composition set forth above, the titanium content is such that at least about 0.02% by weight is present in solution, and at least about 0.025% by weight of columbium is present in solution prior to nitriding. Zirconium may be substituted for columbium either partially or entirely, on a 1:1 basis.

If nitrogen is added to the steel in such an amount that all the nitride forming elements titanium, columbium and aluminum combine completely to form alloy nitrides, and there is no excess nitrogen in the steel in the form of nitrogen in solid solution or as iron nitrides, the steel would then have a theoretical combined nitrogen content, in weight percent, as calculated by the formula:

$$\%\text{N combined as alloy nitrides} = \frac{\%Cb}{6.65} + \frac{\%Ti - 4 \times \%C}{3.43} + \frac{\%Al}{1.93} \quad (1)$$

Two ingots from a heat of steel falling within the preferred composition limits set forth above, were cast, hot rolled, cold rolled to final thickness and annealed in accordance with the process of the present invention. Coil A was cold rolled to 1.524 mm thickness and Coil B to 0.864 mm thickness. The compositions of the cold rolled sheet stocks and tensile properties after recrystallization but before nitriding are set forth in Table I.

In Coil A, substitution of the percentages of the various elements set forth in Table I in formula (1) indicates that the theoretical combined nitrogen content would be 0.062% by weight. For Coil B, corresponding substitution in formula (1) indicates that the theoretical combined nitrogen content would be 0.060% by weight.

Articles of 1.524 mm thickness made from a sample of Coil A were nitrided in a fused cyanate salt bath (sold under the registered trademark "MELONITE" by Kolene Corporation) at 580° C (1075° F) for 1 hour, 2 hours and 3 hours. The resulting Rockwell hardnesses are set forth in Table II, and the through thickness micro-hardness values of the 1 hour and 2 hours specimens are plotted in FIG. 2. It was observed that all samples were quite brittle in the as-nitrided condition, i.e., they exhibited no bend ductility.

It was found that for material of 1.524 mm thickness a nitriding time of greater than 1 hour is unnecessary to obtain the desired final properties in the embodiment of Method I.

For purposes of comparison, sheet samples which were nitrided in fused salt for 1 hour were diffusion annealed both in a non-denitriding atmosphere, and in a hydrogen and nitrogen atmosphere which was denitriding, for various periods of time over the temperature range of 595° to 815° C (1100° to 1500° F). The resulting hardness values are set forth in Table III and are also plotted in the graph of FIG. 3.

By way of further explanation, the samples in the as-nitrided condition had a total nitrogen concentration of 0.19%. As will be evident from FIG. 2, the nitrogen diffusion after one hour of nitriding penetrated to a depth of about 0.508 mm below each surface (i.e. two-thirds of the total thickness).

The data of Table III indicate remarkable increases in strength, as measured by hardness, and these increases are due to the strengthening of the core region by the diffusion of nitrogen inwardly and resultant formation of alloy nitrides, thus completing strengthening throughout the thickness of the steel. Ultimate hardness is reached in a shorter time with increasing diffusion annealing temperature, while the ultimate hardness attained decreases with increasing diffusion annealing temperature. Regardless of time, all samples which were diffusion annealed in air were very brittle as a consequence of retaining an excessively high uncombined nitrogen content and iron nitride surface layers, represented by the difference between the total nitrogen concentration of 0.19% and the theoretical combined nitrogen content of the completely reacted nitride-forming elements of 0.062%.

By way of contrast, the samples subjected to a combined diffusion and denitriding anneal in a gas atmosphere of 20% hydrogen and 80% nitrogen by volume, showed both remarkable increases in strength and a high degree of bend ductility. It was found that all samples so treated could be bent to a bend radius of 3.176 mm or less before cracking occurred. Optimum properties were observed in those samples where the uncombined nitrogen levels were less than 0.03% by weight, i.e., %N after annealing minus 0.062% less than 0.03%.

As indicated above the embodiment of Method II involves the concept of nitriding for a period of time sufficient to provide a total nitrogen concentration which is approximately equal to the amount of nitrogen required to combine completely with the nitride forming elements in the steel, as calculated by formula (1). Immediately after nitriding, this nitrogen content exists at and near the surfaces of the steel as thin surface layers of epsilon iron nitride and as a subsurface concentration which decreases with increasing distance below the surface. After the nitriding step the article still has very low strength. Strengthening is effected by the step of diffusion annealing, wherein the surface concentration of nitrogen is caused to diffuse substantially throughout the thickness of the article and react with the nitride forming elements to form small, uniformly dispersed nitride precipitates, thereby providing substantial strengthening.

In accordance with Method II, samples of 1.524 mm thickness steel of Coil A were nitrided in a fused cyanate salt bath at 580° C (1075° F) for 5, 15, 30 and 60 minutes. The resulting hardnesses and total nitrogen contents after nitriding are set forth in Table IV. Again it will be noted that this steel required a theoretical nitrogen content of 0.062% by weight for complete reaction of all the nitride-forming elements in the steel to form nitrides.

These samples were then diffusion annealed in an air atmosphere for various times within the temperature range of 595° to 815° C (1100° to 1500° F). The test data and resulting hardnesses are summarized in Table IV. Samples designated as A-5 were not sufficiently nitrided to achieve the full strength potential of steel of this composition, and the resulting Rockwell B hardness values were thus lower than desirable.

Samples designated as A-60 reached too high a total nitrogen level, and while the hardnesses after diffusion annealing were very high, the steel was brittle, as determined by bend ductility tests. Samples A-15 and A-30 exhibited hardnesses which correlated with desirably high strengths after diffusion annealing and good bend ductilities. Thus was attributed to the fact that the total nitrogen content after nitriding was either only slightly less (0.054%) or only slightly greater (0.071%) than the 0.062% theoretical total nitrogen content required to react completely with the nitride forming elements, as determined by formula (1).

The diffusion annealing in air resulted in slight surface oxidation which was easily removed by acid pickling, or abrasive cleaning such as sand or glass bead blasting.

For purposes of comparison, further specimens of Samples A-15 and A-30 were diffusion annealed in a neutral salt bath and in air for varying lengths of time within the temperature range of 650° to 705° C (1200° to 1300° F), and hardness tests were conducted. These results are set forth in Table V, from which it will be noted that the Rockwell hardness values were extremely close, thus indicating the substantially full equivalence, from the standpoint of strength properties, of diffusion annealing either in air or in a neutral fused salt bath, in the embodiment of Method II.

TABLE I

CHEMICAL COMPOSITIONS-PERCENT BY WEIGHT AND TENSILE PROPERTIES OF UNTREATED STEEL SHEET

| | Cb | Ti | Al | C | N | Mn | S | P | Si | Fe |
|---|---|---|---|---|---|---|---|---|---|---|
| Coil A | 0.056 | 0.13 | 0.049 | 0.008 | 0.004 | 0.29 | 0.012 | 0.008 | 0.011 | balance |
| Coil B | 0.058 | 0.12 | 0.049 | 0.008 | 0.006 | 0.29 | 0.012 | 0.008 | 0.011 | balance |

| | Yield Strength-MPa | Tensile Strength-MPa | Percent Elong. in 2in. | Plastic Strain Ratios r-0° | r-45° | r-90° | $r_m$* |
|---|---|---|---|---|---|---|---|
| Coil A | 129 | 317 | 48 | 2.00 | 1.70 | 2.47 | 1.97 |
| Coil B | 140 | 326 | 45 | 1.67 | 1.90 | 2.40 | 1.97 |

MPa = Megapascal (1 MPa = 145 psi)

*$r_m = \frac{1}{4}$ (r-0° + r-90° + 2r-45°)

TABLE II

LOW TEMPERATURE LIQUID SALT NITRIDING OF 1.524 MM THICK SHEET (COIL A), INITIALLY HAVING A HARDNESS OF HRB-40, YIELD STRENGTH - 129 MPa

| Time in Salt-580° C | Rockwell Hardness | Thickness of Iron-Nitride Surface Layers | Thickness of Strengthened Surface Layers | Thickness of Unstrengthened Center Core Layer | % Nitrogen By Weight | Bend Ductility |
|---|---|---|---|---|---|---|
| 1 Hr | 92B | .0122 mm | .508 mm | .508 mm | 0.19 | nil |
| 2 Hr | 22C | .0152 mm | .635 mm | .254 mm | N.D.* | nil |
| 3 Hr | 36C | .0152 mm | Full through thickness strengthened | | N.D. | nil |

*N.D. = Not Determined

TABLE III

HARDNESS AFTER ANNEALING OF 1.52 MM SHEET (COIL A), LOW TEMPERATURE LIQUID SALT NITRIDED 580° C - 1 Hr. WITH AN AS-NITRIDED HARDNESS HRB = 92, 0.19% $N_2$

| | | Hardness-HRC | | |
|---|---|---|---|---|
| Temp.-° C | Time-Hrs. | Annealed in Air* | Annealed in 20%$H_2$ + 80%$N_2$** | %N After 20%$H_2$ + 80%$N_2$ Anneal |
| 595 | 1/2 | 20 | — | — |
| | 1 | 28 | — | — |
| | 2 | 35.5 | — | — |
| | 3 | 37 | — | — |
| 650 | 1/6 | 16 | — | — |
| | 1/2 | 27 | 28 | 0.090 |
| | 1 | 35 | 28.5 | 0.071 |
| | 2 | 36 | 26 | 0.070 |
| 705 | 1/6 | 16 | — | — |
| | 1/2 | 28 | 27 | 0.085 |
| | 1 | 33 | 22 | 0.068 |
| | 2 | 33.5 | 23 | 0.066 |
| 760 | 1/6 | 16.5 | 14.5 | N.D. |
| | 1/3 | — | 16.5 | N.D. |
| | 1/2 | 25 | 16.5 | 0.068 |
| | 1 | 28.5 | 17 | 0.065 |
| 815 | 1/2 | 22 | 14 | N.D. |

*All samples annealed in air had no bend ductility

**All samples annealed in 20%$H_2$ + 80%$N_2$ had good bend ductility. One inch wide bend samples could be bent with bend radius of 3.176 mm or smaller without cracking.

TABLE IV

HARDNESS OF 1.52MM SHEET (COIL A) AFTER LOW TEMPERATURE LIQUID SALT NITRIDING (580° C) AND AFTER DIFFUSION ANNEALING IN AIR

As Salt Nitrided:

| Sample Code | Salt Nitriding Time - min. | Hardness-HRB | % $N_2$ |
|---|---|---|---|
| A-5 | 5 | 56 | 0.039 |
| A-15 | 15 | 64 | 0.054 |
| A-30 | 30 | 74 | 0.071 |
| A-60 | 60 | 92 | 0.19 |

Salt Nitrided and Diffusion Annealed in Air:

| | | Rockwell Hardness-Scale Designated | | | | |
|---|---|---|---|---|---|---|
| Temp-° C | Time-Hrs | Sample A-5 | Sample A-15 | Sample A-30 | | Sample A-60 |
| 595 | 1/2 | — | — | — | | 20C |
| | 1 | — | 88B | 95B | | 28C |
| | 2 | — | 18.5C | 25C | | 35.5C |
| | 3 | — | — | — | | 37C |
| | 4 | — | 25C | 27.5C | | — |
| | 6 | — | 24C | 27C | | — |
| 650 | 1/2 | 83B | 88B | 93B | | 27C |
| | 1 | 87B | 18C | 24.5C | | 35C |
| | 2 | 88B | 21.5C | 26.5C | | 36C |
| | 3 | 89B | 20C | 26C | | — |
| 705 | 1/2 | — | 92B | 14.5C | (96B) | 28C |
| | 1 | — | 93B | 22C | | 33C |
| | 2 | — | 92B | 22C | | 33.5C |
| 760 | 1/6 | — | — | — | | 16.5C |
| | 1/2 | — | — | — | | 25C |
| | 1 | — | — | — | | 28.5C |
| 815 | 1/2 | — | — | — | | 22C |

TABLE V

HARDNESS COMPARISON OF 1.524mm SHEET (COIL A) DIFFUSION ANNEALED IN AIR AND IN A NEUTRAL SALT BATH AFTER SALT NITRIDING

| | | | Rockwell Hardness-Scale Designated | |
|---|---|---|---|---|
| Sample | Diffusion Temp-° C. | Diffusion Time-Hrs. | Air | Neutral Salt |
| A-15 | 650 | 2 | 21.5C | 23C |
| A-15 | 705 | ½ | 92B | 90B |
| A-15 | 705 | 1 | 93B | 92B |
| A-15 | 705 | 2 | 92B | 91B |
| A-30 | 650 | 2 | 26.5C | 27C |
| A-30 | 705 | ½ | 96B | 96B |
| A-30 | 705 | 1 | 22C | 22.2C |
| A-30 | 705 | 2 | 22C | 23C |

The 0.864 mm cold rolled and annealed sheet specimens of Coil B were also processed by the embodiment of Method II and submitted to similar tests. The hardness values and tensile properties under varying treatment conditions are summarized in Tables VI and VII, respectively. Keeping in mind that the theoretical combined nitrogen content for this steel was 0.060% by weight as determined by formula (1), it will be evident that Samples B-10 and B-20 represent preferred nitriding conditions. The yield strengths of these preferred samples ranged from about 588 to about 736 MPa, and ductility as measured by percent elongation was satisfactory, ranging between 11 and 13%.

In both embodiments of the method of this invention, it can be reasonably predicted that high strength parts or articles requiring a highly formable steel can be formed of lighter gauge material in place of using conventional formable steels of greater thickness which are not subsequently strengthened. For such purposes a minimum yield strength of about 550 MPa would be desirable. The particular combination of time and temperature of the diffusion anneal can be selected in the practice of this invention to meet the strength requirements for the article so-treated.

The particular processing conditions, both with respect to the nitriding time in the fused salt bath and the time and temperature of the diffusion anneal will depend on the thickness of the steel sheet or strip from which the articles are formed. Thinner gauges will require less time, while thicker gauges will require more time, again dependent upon the strength levels desired to be achieved.

The total cycle time involved in the two-step method of the present invention for steel having a thickness of about 0.060 inch (1.524 mm), would be about 1½ hours, plus a relatively short time for heating and cooling the articles. In contrast to this, cycle times of about 12 to 20 hours would be required for batch type prior art gas nitriding methods of strengthening. As indicated above, the ultimate strength level which can be reached decreases while the time required to reach it decreases with increasing diffusion annealing temperature. For economy of operation and highest production rates, it is preferred to select an annealing temperature at which the desired strength can be reached in the shortest time. The annealing time at the selected temperature preferably should be such that the ultimate strength level is reached within the selected time, and with additional annealing time no further strength increase occurs. This would follow from the concept of the present invention that the initially high surface concentration of nitrogen can be diminished completely by diffusion inwardly, so that surface embrittlement does not result.

The choice of the type of anneal in Method II, as between annealing in air, in a non-oxidizing and non-denitriding atmosphere, or in a neutral salt bath, will depend upon facilities already existing in a particular plant, the capital investment available for a new installation and the size and configuration of the articles being

TABLE VI

HARDNESS OF 0.864mm SHEET (COIL B) AFTER LOW TEMPERATURE LIQUID SALT NITRIDING (580° C) AND AFTER DIFFUSION ANNEALING IN AIR

As Salt Nitrided:

| Sample Code | Salt Nitriding Time-Min. | Hardness-HRA | % $N_2$ |
|---|---|---|---|
| B-0 | 0 | N.D. | 0.006 |
| B-5 | 5 | 36.3 | 0.034 |
| B-10 | 10 | 39.0 | 0.046 |
| B-20 | 20 | 44.5 | 0.064 |
| B-25 | 25 | 48.1 | 0.074 |

Salt Nitrided and Diffusion Annealed in Air:

| Temp-° C | Time Hrs. | Hardness-HRA | | | |
|---|---|---|---|---|---|
| | | Sample B-5 | Sample B-10 | Sample B-20 | Sample B-25 |
| 595 | 1/2 | 48.0 | 53.2 | 59.1 | 62.1 |
| | 1 | 51.3 | 56.0 | 61.4 | 62.0 |
| | 2 | 55.7 | 59.0 | 61.4 | 62.6 |
| 650 | 1/4 | 51.1 | 55.1 | 60.1 | 62.7 |
| | 1/2 | 54.5 | 59.0 | 63.5 | 63.6 |
| | 1 | 56.9 | 60.8 | 62.8 | 63.3 |
| 705 | 1/12 | 45.2 | 49.6 | 56.9 | 59.8 |
| | 1/4 | 52.2 | 58.7 | 62.2 | 63.7 |
| | 1/2 | 51.6 | 58.7 | 61.9 | 63.2 |
| | 1 | 52.0 | 58.7 | 61.5 | 63.7 |

TABLE VII

TENSILE PROPERTIES OF .864 MM SHEET (COIL B) STRENGTHENING BY LOW TEMPERATURE LIQUID SALT NITRIDING AND DIFFUSION ANNEALING IN AIR

| Salt Nitriding Time-Min. | Diffusion Annealing Temp.-° C | Time Hrs. | Y.S. Mpa | T.S. MPa | % Elong. in 2" | HRA |
|---|---|---|---|---|---|---|
| Untreated | — | — | 140 | 325 | 45 | N.D. |
| 5 | 650 | 1 | 581 | 643 | 14 | 56.0 |
| 10 | 650 | 1 | 650 | 701 | 12 | 59.5 |
| 20 | 650 | 1 | 736 | 776 | 13 | 62.2 |
| 25 | 650 | 1 | 760 | 816 | 13 | 62.8 |
| 5 | 705 | ½ | 515 | 596 | 15 | 53.0 |
| 10 | 705 | ½ | 588 | 649 | 11 | 57.5 |
| 20 | 705 | ½ | 703 | 761 | 13 | 61.9 |
| 25 | 705 | ½ | 736 | 794 | 12 | 62.9 |

Figure 3:
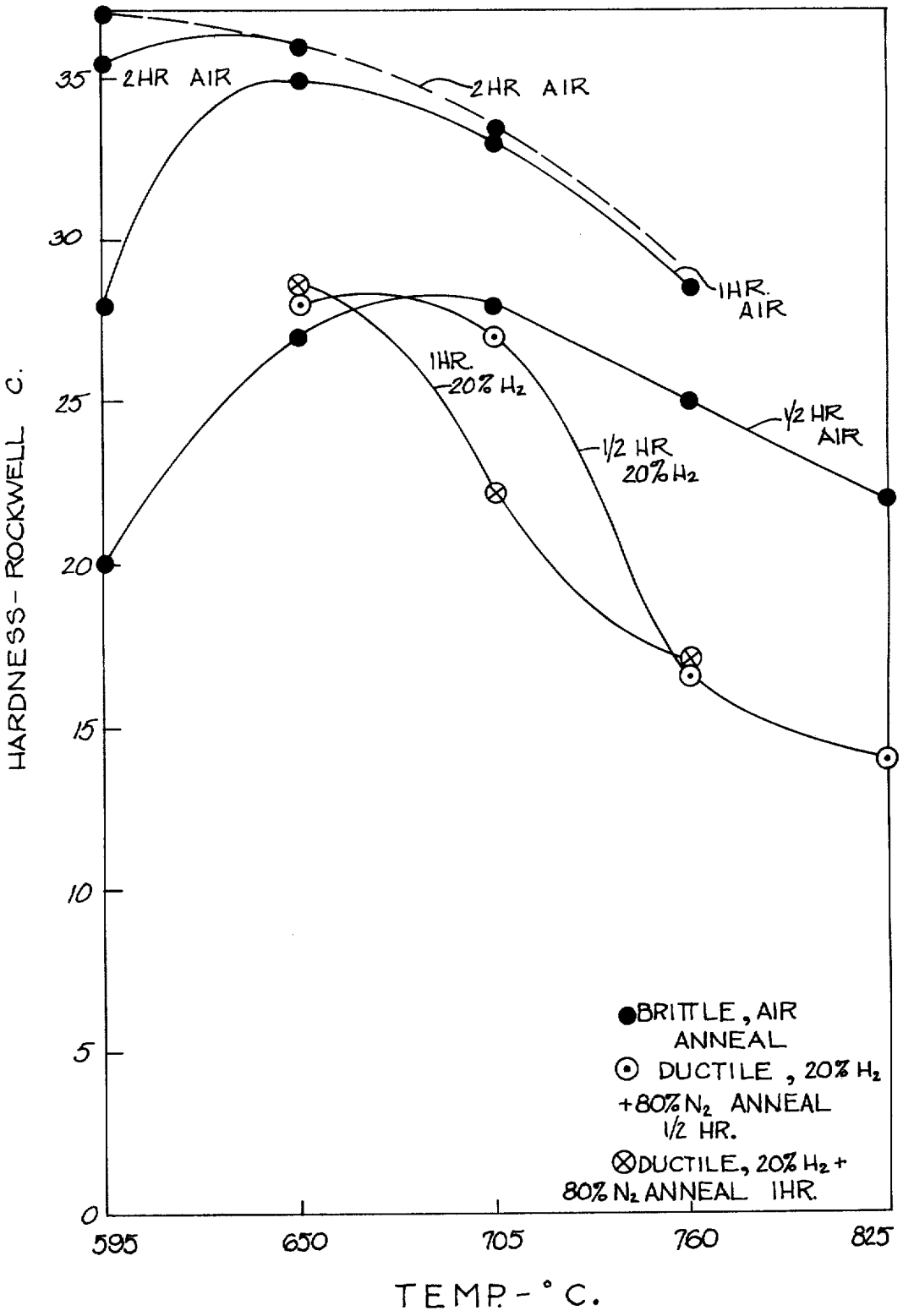
FIG. 3 is a graphic illustration of the effect of the diffusion annealing time, temperature and atmosphere on hardness of 0.060 inch thickness material nitrided for 1 hour at 580° C (1075° C) by the embodiment of Method I.

The graph of FIG. 3 shows that for diffusion-denitriding annealing times of 1/2 and 1 hours (Method I in a hydrogen and nitrogen atmosphere) the Rockwell hardness values ranged from about 28.5 to about 16.5 within the temperature range of 1200° to 1400° F (650° to 760° C). The correlation of these hardness values with yield strength in the graph of FIG. 1 show that this would correspond to a yield strength range from at least about 115 to about 85 ksi (795 to 585 MPa). The relatively short annealing time thus makes the process adaptable to a continuous annealing type of operation wherein the heat-up and cool-down times are negligible compared to the times required for batch type processing. Moreover, the fused salt bath nitriding first step in both embodiments of the present method is of sufficiently short duration to lend itself to a continuous operation. Here again, negligible heat-up and cool-down times would be needed in the fused salt bath nitriding step.

treated. In general, a neutral salt bath would provide optimum production rate.

With respect to the ultimate strength levels attainable by the method of the present invention, it has been found that somewhat higher yield and tensile strengths can be obtained in comparison to the levels attainable in the method of the above-mentioned U.S. Pat. No. 3,847,682. Samples of Coil A having a thickness of 0.060 inch (1.524 mm) were subjected to strengthening by the process of this patent and by the embodiment of Method II of the present invention, and the comparison is shown in the data of Table VIII. A similar comparison was conducted with specimens of Coil B, having a thickness of 0.034 inch (0.864 mm), and these results are summarized in Table IX. In both instances, the greatly shortened processing time of the present invention is striking, coupled with the fact that higher strength levels were achieved.

TABLE VIII

COMPARATIVE STRENGTHENING OF THE SAME 1.524 MM STEEL SHEET (COIL A) BY PRIOR ART GAS NITRIDING VS. PRESENT INVENTION METHOD II

| Treatment | Wt-Percent* Nitrogen After Treatment | Y.S. MPa | Y.S. MPa | % Elong. in 2" |
|---|---|---|---|---|
| Gas. Nitr: 3%$NH_3$ in 15%$H_2$+85%$N_2$, 650° C-4 hr., plus denitr. in 100%$H_2$, 705° C-3 hr. | 0.071 | 662 | 731 | 14 |
| Method II: Nitr. in fused salt,-580° C-½ hr plus diffusion anneal in air, 650° C-2 hr. | 0.071 | 774 | 842 | 14 |
| Method II: Nitr. in fused salt 580° C-½ hr. plus diffusion anneal in air, 650° C 2 hr. | 0.054 | 689 | 749 | 15 |

*Theoretical combined nitrogen as alloy nitrides for this steel is 0.062 wt. percent

TABLE IX

COMPARATIVE STRENGTHENING OF THE SAME .864 MM STEEL SHEET (COIL B) BY PRIOR ART GAS NITRIDING VS. PRESENT INVENTION METHOD II

| Treatment | Wt-Percent* Nitrogen After Treatment | Y.S. MPa | Y.S. MPa | % Elong. in 2" |
|---|---|---|---|---|
| Gas Nitr: 5%$NH_3$ in 15%$H_2$+85%$N_2$, 650° C-4 hr., plus denitr. in 100%$H_2$, 650° C-4 hr. | 0.061 | 630 | 709 | 12 |
| Method II: Nitr. in fused salt, 580° C-20 min. plus diffusion anneal in air 650° C-1 hr. | 0.064 | 736 | 776 | 13 |
| Method II: Nitr. in fused salt, 580° C-10 min. plus diffusion anneal in air 650° C-1 hr. | 0.046 | 650 | 701 | 12 |

*Theoretical combined nitrogen as alloy nitrides for this steel is 0.060 wt. percent Cold rolled steel sheet or strip stock from which deep drawn articles are formed undergoes plastic deformations in the forming process which results in work hardening. The work hardening is manifest by an increase in hardness and strength and a decrease in ductility compared to the undeformed stock. Such an article usually displays a wide range of work hardening, varying from substantially none in unstrained areas to a high degree in severely plastically deformed or strained areas. The preceding examples of internal strengthening of articles by the process of this invention pertain to initially fully recrystallized samples and represent the response which would be demonstrated by relatively unstrained regions of a formed article.

It is well known that free nitrogen, i.e., nitrogen not rendered harmless by the presence of strong nitride formers, can have a pronounced effect in producing brittleness in steel after work hardening. Reference may be made to "Nitrogen In Ferritic Steels—A Critical Survey of the Literature", by W. C. Leslie, AISI, New York, New York, January 1959.

A severely deformed or strained region of an article formed from the steel of the present composition would not be expected to recover or recrystallize in the nitriding step of the strengthening process because of the relatively low temperatures and short times involved. After the nitriding step, the alloy nitride precipitates and the high nitrogen concentration in the surface regions would inhibit recovery and recrystallization even at the higher temperature of the diffusion annealing step which follows. However, there is no evidence in the prior art on which a skilled worker could base a belief that this cold strained material either would or would not be embrittled after treatment by the process of the present invention.

In theory, if the amount of nitrogen introduced by the present method is equal to or less than the amount which can be combined as alloy nitrides in accordance with formula (1), all the nitrogen should be in an inocuous combined form, and no embrittlement should occur. However, when nitrogen is introduced into a cold worked or strained region rather than into recrystallized material, it is possible that some of the nitrogen segregates to the cold worked defect structure rather than forming nitrides, thereby producing embrittlement. It is also possible that alloy nitrides might form preferentially along cold worked or strained grain boundaries. If the strain is significantly anisotropic, ductility may be anisotropic, i.e., the direction parallel to the direction of grain elongation may be one of low cracking resistance.

A situation wherein potential embrittlement problems can be evaluated occurs upon introduction of work hardening by cold rolling, i.e., additional cold rolling after the cold rolling and recrystallization anneal which normally precedes the nitriding treatment described above. Cold rolling can be used to simulate directional flow which would occur in forming a stamped or formed article.

It has been discovered that in those instances of deep drawing and/or additional cold rolling which would result in work hardened or strained regions giving rise to embrittlement, a recovery or recrystallization anneal prior to the nitriding operation overcomes the problem and avoids cracking. In other words, the sequence of steps where there is no problem of embrittlement includes cold rolling to strip or sheet thickness, recrystallization annealing, forming into an article by drawing or stamping, nitriding and diffusion annealing. In the situations where embrittlement may pose a problem, the formed article is subjected to a recovery or recrystallization anneal prior to the nitriding step. A recovery anneal can be conducted at about 650° C for 10 to 40 minutes, while a full recrystallization anneal may be conducted at about 730° C for about 10 minutes. A full recrystallization anneal is preferred.

However, it should be recognized that for some types of articles formed by drawing and/or stamping, embrittlement would not present a problem.

Tests have been carried out which illustrate the effectiveness of the above described additional recovery or recrystallization anneal of the formed article where embrittlement is a problem. Blanks cut from 1.524 mm thick sheet of Coil A were deep drawn into 50.8 mm diameter flat bottom cylindrical cups. Cylindrical rings having a width of 0.75 inch (19 mm) were cut from the open ends of the cups after trimming the ears. These rings represented material having the highest degree of plastic deformation in the drawn cups and attained a hardness of RB 86 as a result of work hardening. Some of the sample rings were subjected to a recrystallization anneal at 1350° C (732° C) for 10 minutes, which lowered the hardness to RB 45, while other rings were subjected to a recovery anneal at 1200° F (650° C) for about ½ hour, which lowered the hardness to RB 75. The ring specimens in all three conditions (cold work hardened, recovery annealed, and recrystallization annealed) were then subjected to nitriding in a fused cyanate salt bath followed by diffusion annealing.

Figure 4A:
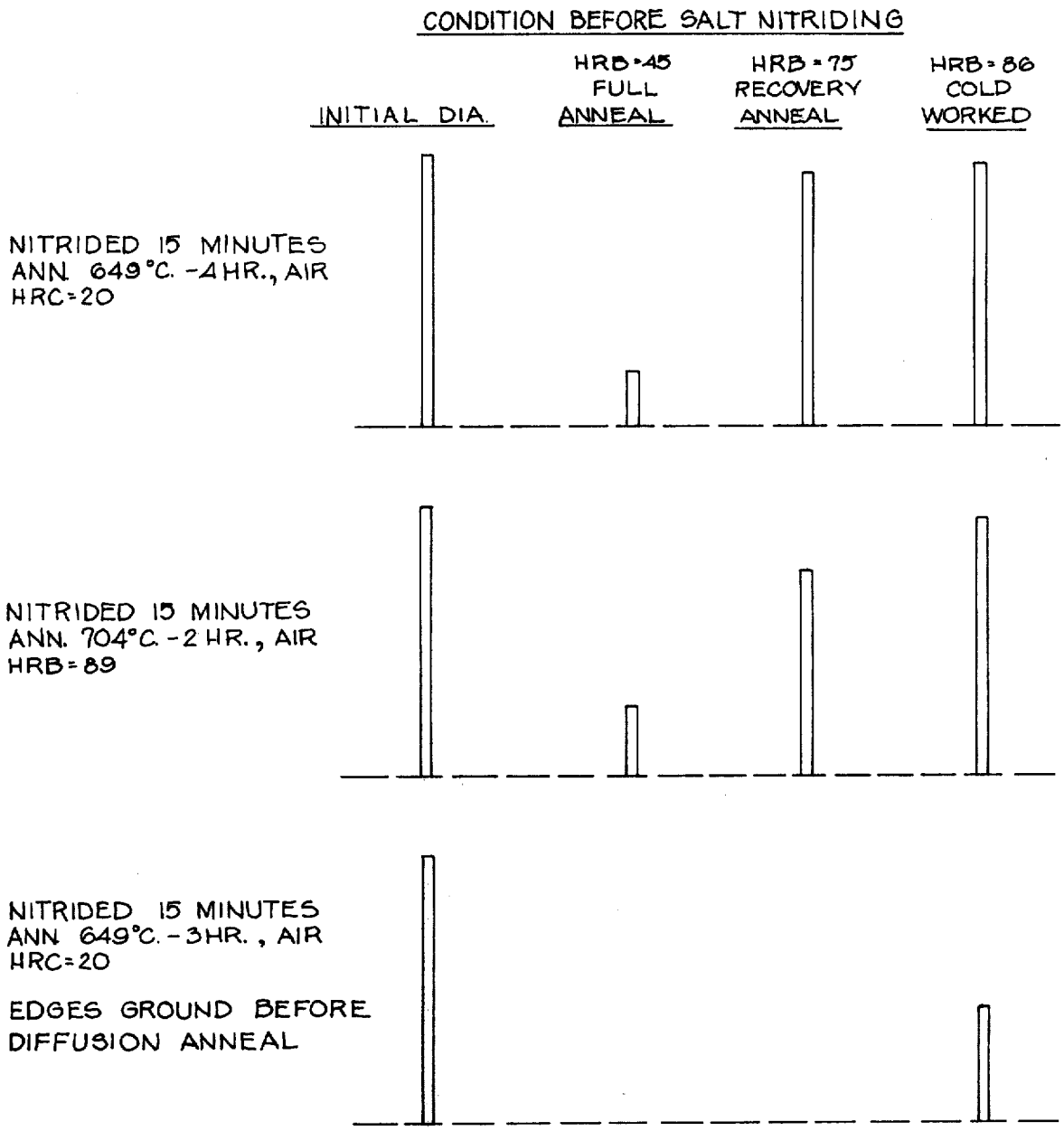
FIG. 4 is a graphic representation of relative ductilities of deep drawn cylindrical rings after nitriding and annealing in a non-denitriding atmosphere.
Figure 5D:
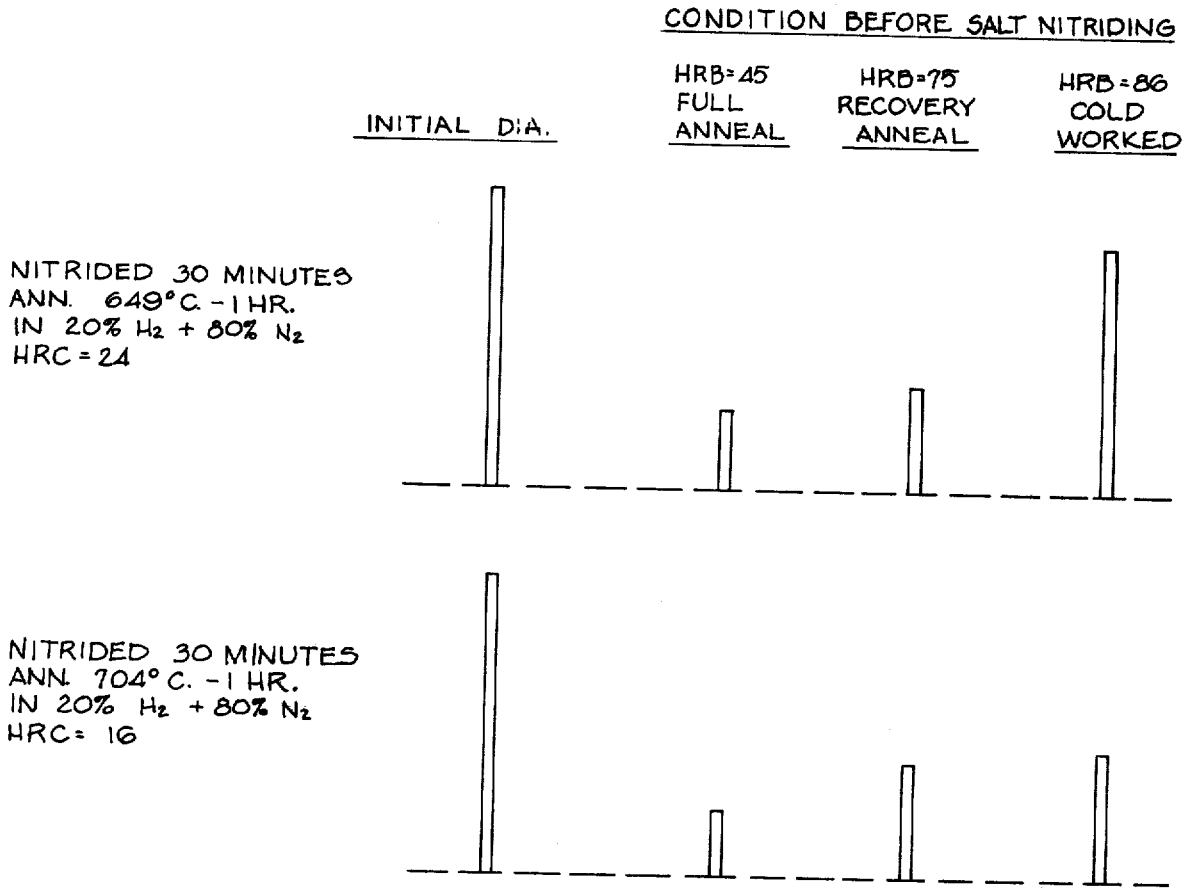
FIG. 5 is a graphic representation of relative ductilities of deep drawn cylindrical rings after nitriding and annealing in a denitriding atmosphere.

The rings were then compressed between platens with the axis of loading parallel to the ring diameter. This placed the inside ring surfaces in tension at the points of contact with the platens and the outside ring surfaces in tension at 90° to the platen contact points. The rings were collapsed to the point where the first cracking occurred. The ring heights, including springback, measured between inside surfaces, are shown in FIGS. 4 and 5. The differences between the cold work hardened and annealed specimens are readily apparent. In the specimens represented in FIG. 4, nitriding was followed by diffusion annealing in air (i.e., under non-denitriding conditions), whereas the specimens of FIG. 5 were subjected to nitriding followed by annealing under denitriding conditions. It is evident that embrittlement tends to be less severe in the specimens of FIG. 5 which were diffusion annealed under denitriding conditions.

It was also found that if an initially cold work hardened ring was edge ground after salt nitriding, but before diffusion annealing, its ductility was significantly better. Excess nitrogen present at the edges of the ring, which are of course nitrided along with the parallel sheet surfaces, is thus detrimental to ductility.

The above type of test is believed to be the most severe condition which could be imposed, with a very high degree of cold working and a high degree of grain elongation in the sample parallel to the direction of cracking.

Further tests involving additional cold rolling were carried out by subjecting cold rolled and fully annealed sheet stock of 1.524 mm thickness (Coil A) to cold rolling to a thickness of 0.864 mm. Some of these specimens were subjected to various annealings under conditions set forth in Table X. Specimens in the three conditions were then subjected to nitriding and diffusion annealing in air. The mechanical properties of these specimens are set forth in Table X. It will be evident that the longitudinal tensile properties, i.e., parallel to the rolling direction, showed no significant differences in elongation between cold plastically deformed and annealed material. Similarly, all specimens passed the longitudinal 7T bend tests, where the maximum outer fiber strain was 12.4 %. However, the cold work hardened specimens failed in transverse bend tests where the applied stress was normal to the rolling direction, and cracking occurred parallel to the rolling direction. This corresponds to the direction of grain elongation in cold working.

In order to confirm these findings, the ring specimens described above were subjected to longitudinal bend tests, and it was found that the samples cut from the rings exhibited good longitudinal bend ductility when the tensile direction was parallel to the direction of grain elongation, i.e., parallel to the cylindrical axis of the ring.

It is thus evident that if embrittlement does occur as a result of a high degree of cold work hardening, the ductility is anisotropic; the ductility remains good parallel to the direction of grain flow or elongation but is poor transverse to the direction of grain flow. Consequently, the possible harmful effect of embrittlement in cold worked regions of formed articles after nitriding can be evaluated for each particular type of article, relative to its geometry, specific application, type and direction of stress relative to geometry and the like, in order to ascertain whether a recovery or recrystallization anneal should be performed on the formed article prior to nitriding.

TABLE X

STRENGTH AND DUCTILITY OF 0.864 MM THICK SAMPLES INITIALLY IN THE COLD WORKED, RECOVERY ANNEALED AND RECRYSTALLIZATION ANNEALED CONDITIONS, THEN SALT NITRIDED AND DIFFUSION ANNEALED IN AIR

| INITIAL CONDITION | | | Longitudinal Tensile Properties | | |
|---|---|---|---|---|---|
| Sample Code | Treatment | Rockwell Hardness | 0.5% yield Strength-MPa | Tensile Strength-MPa | % Elong. in 2"(50.8mm) |
| C | Cold Rolled 43% from 1.524 to 0.864 mm | 53A, 87B | 535 | 536 | 3 |
| R | Cold Rolled 43% and recovery annealed 677° C - 10 min. | 45A, 71B | 380 | 415 | 18 |
| A | Cold Rolled 43% and fully annealed 732° C - 10 min. | 39B | 188 | 310 | 39 |

| STRENGTHENED CONDITION | | | | Longitudinal Tensile Properties | | | Bend Tests - 7T(3.05 mm Radius Punch) | |
|---|---|---|---|---|---|---|---|---|
| Sample Code | Strengthening Treatment | wt. pct. $N_2$ | HRA | 0.5% yield Strength-MPa | Tensile Strength-MPa | % Elong. in 2" | Longitudinal | Transverse |
| C | Salt Nitrided 579° C - 10 min. plus Air annealed 649° C - 1 hr. | 0.045 | 58.9 | 680 | 700 | 9.0 | passed | cracked |
| R | | 0.053 | 61.5 | 707 | 728 | 12.0 | passed | passed |
| A | | 0.056 | 61.9 | 707 | 755 | 11.5 | passed | passed |

TABLE X-continued

STRENGTH AND DUCTILITY OF 0.864 MM THICK SAMPLES INITIALLY IN THE COLD WORKED, RECOVERY ANNEALED AND RECRYSTALLIZATION ANNEALED CONDITIONS, THEN SALT NITRIDED AND DIFFUSION ANNEALED IN AIR

| | | | | | | | | |
|---|---|---|---|---|---|---|---|---|
| C | Salt Nitrided 579° C - 15 min. | 0.058 | 63.0 | 756 | 770 | 13.0 | passed | cracked |
| | plus | | | | | | | |
| R | Air annealed 649° C - 1 hr. | 0.069 | 63.3 | 769 | 788 | 12.0 | passed | passed |
| A | | 0.069 | 62.8 | 748 | 795 | 13.5 | passed | passed |

The cyanate salt nitriding bath referred to throughout this specification may be the "MELONITE" type used by Kolene Corporation, or the new "TUFFTRIDE" type, referred to in the above-mentioned "Heat Treatment of Metals" articles. New "TUFFTRIDE" is stated to comprise sodium and potassium cyanate and carbonate salts to which a cation-free regenerator is added during operation. The cyanate content of such a bath is between about 36 and 39%. Baths of this type of course avoid the problems of extreme toxicity and disposal of residue from the previously used fused salt nitriding baths which contained up to about 50% potassium cyanide. However, it is within the scope of the present application to utilize a cyanide nitriding bath if the problems inherent therein would not be considered disadvantageous under some operating conditions. Moreover, although the use of a fused salt nitriding bath is greatly preferred, it is nevertheless within the scope of the present invention to substitute as the initial nitriding step a gaseous nitriding atmosphere such as vacuum nitrocarburizing or the process practiced under the registered trademark "TRINIDING", provided that the temperature and time ranges do not exceed those disclosed herein for nitriding in either of the embodiments Method I and Method II for the nitriding step.

Still other modifications may be apparent to those skilled in the art and are considered to be within the scope of the present invention. Hence, no limitations are to be inferred, except insofar as specifically set forth in the claims which follow.

The embodiments of the invention in which an exclusive property or privilege is claimed are defined as follows:

1. A method for internal strengthening of articles formed from a deep drawing quality steel sheet of strip stock, which comprises:

providing a vacuum decarburized and deoxidized steel melt containing, in weight percent, from about 0.002 to about 0.015% carbon, up to about 0.012% nitrogen, up to about 0.08% aluminum, about 0.05 to about 0.6% manganese, up to about 0.035% sulfur, up to about 0.01% oxygen, up to about 0.01% phosphorus, up to about 0.015% silicon, about 0.02 to about 0.3% titanium in solution, up to about 0.3% columbium in solution, and remainder iron except for incidental impurities, columbium when present being added in an amount of at least 0.025% in solution, with the sum total of titanium and columbium in solution not exceeding about 0.3%;

reducing said steel to final thickness by steps involving casting, hot rolling to strip thickness, removing the hot mill oxide scale, and cold rolling to strip or sheet thickness;

annealing to obtain a fully recrystallized, ductile, deep drawing steel strip or sheet;

forming said article from said annealed strip or sheet;

heating said article at a temperature of about 570° to about 580° C in a nitriding fluid chosen from the group consisting of a fused salt nitriding bath, and a gaseous nitriding atmosphere, whereby to form on the surfaces of said article an epsilon iron nitride layer, said heating being conducted in said fluid for a period of time, proportional to the thickness of said steel strip or sheet, sufficient to provide a total nitrogen concentration at least substantially equal to the amount theoretically required to combine completely with said titanium, aluminum and columbium in said steel; and diffusion annealing said article in a non-nitriding fluid at a temperature of about 595° to about 815° C for a period of time, dependent on said strip or sheet thickness, sufficient to complete through-thickness strengthening by reaction of said nitrogen with said titanium, aluminum and columbium.

2. The method claimed in claim 1, wherein said article is nitrided in a fused cyanate salt bath for a period of time sufficient to provide nitrogen diffusion through a substantial part of the thickness of said strip or sheet and a total nitrogen content exceeding said amount theoretically required to combine completely with said titanium, aluminum and columbium, and wherein said diffusion anneal is conducted in a denitriding atmosphere of hydrogen and nitrogen at a temperature of about 650° to about 730° C for a period of time sufficient to reduce the level of excess nitrogen in solid solution and as iron nitrides to less than about 0.03% by weight.

3. The method claimed in claim 1 wherein said article is nitrided in a fused cyanate salt bath for a period of time sufficient to provide a total nitrogen content substantially equal to said amount theoretically required to combine completely with said titanium, aluminum and columbium, and wherein said diffusion anneal is conducted in a non-denitriding fluid.

4. The method claimed in claim 3, wherein said diffusion anneal is conducted in a non-denitriding fluid chosen from the class consisting of air, a non-oxidizing gas, and a neutral salt bath.

5. The method claimed in claim 2, wherein said article is nitrided with a time at temperature of about ¼ to 1 hour, and wherein said diffusion anneal is conducted with a time at temperature of about ½ to about 2 hours.

6. The method claimed in claim 3, wherein said article is nitrided with a time at temperature of about 5 minutes to about 1 hour, and wherein said diffusion anneal is conducted with a time at temperature of about 10 minutes to about 3 hours.

7. The method claimed in claim 1, wherein said steel melt contains, in weight percent, less than about 0.010% carbon, up to about 0.004% nitrogen, about 0.02% to about 0.06% total aluminum, about 0.05 to about 0.6% manganese, up to about 0.035% sulfur, up to about 0.01% oxygen, residual phosphorus and silicon, about 0.05 to about 0.15% total titanium, about 0.03% to about 0.06% total columbium, and balance iron except for incidental impurities, there being at least about 0.02% titanium in solution, and at least about 0.025% columbium in solution.

8. The method claimed in claim 1, wherein said article is formed by operations imparting severe cold work hardening thereto, and including the step of subjecting said article to a recrystallization anneal at a temperature of about 730° C for about 10 minutes, prior to said step of heating said article in a fluid capable of forming on the surfaces thereof an epsilon iron nitride layer.

9. The method claimed in claim 1, wherein said article is formed by operations imparting severe cold work hardening thereto, and including the step of subjecting said article to a recovery anneal at a temperature of about 650° C for at least about 10 minutes, prior to said step of heating said article in a fluid capable of forming on the surfaces thereof an epsilon iron nitride layer.

10. A continuous process for internal strengthening of articles formed from a deep drawing quality cold rolled and fully recrystallized steel sheet or strip stock containing, in weight percent, from about 0.02 to about 0.015% carbon, up to about 0.012% nitrogen, up to about 0.08% aluminum, about 0.05 to about 0.6% manganese, up to about 0.035% sulfur, up to about 0.01% oxygen, up to about 0.01% phosphorus, up to about 0.015% silicon, about 0.02 to about 0.3% titanium in solution, up to about 0.3% columbium in solution, and remainder iron except for incidental impurities, columbium when present being added in an amount of at least 0.025% in solution, with the sum total of titanium and columbium in solution not exceeding about 0.3%, comprising the steps of passing said articles through a fused nitriding salt bath at a temperature of about 570° to about 580° C for a period of time sufficient to provide a total nitrogen concentration at least substantially equal to the amount theoretically required to combine completely with said titanium, aluminum and columbium in said steel; and subjecting said articles to a continuous diffusion anneal in a non-nitriding fluid at a metal temperature of about 595° to about 815° C for a period of time sufficient to complete through-thickness strengthening by reaction of said nitrogen with said titanium, aluminum and columbium.

11. The process claimed in claim 10, wherein said articles are nitrided in a fused cyanate salt bath for a period of time sufficient to provide a total nitrogen concentration exceeding said amount theoretically required to combine completely with said titanium, aluminum and columbium, and wherein said diffusion anneal is conducted in a denitriding atmosphere of about 20% hydrogen and about 80% nitrogen by volume for a period of time sufficient to reduce the level of excess nitrogen in solid solution and as iron nitrides to less than about 0.03% by weight.

12. The process claimed in claim 10, wherein said articles are nitrided in a fused cyanate salt bath for a period of time sufficient to provide a total nitrogen concentration substantially equal to said amount theoretically required to combine completely with said titanium, aluminum and columbium, and wherein said diffusion anneal is conducted in a non-denitriding fluid.

13. The process claimed in claim 12, wherein said non-denitriding fluid is chosen from the class consisting of air, a non-oxidizing atmosphere, and a fused neutral salt bath.

14. The process claimed in claim 10, wherein said articles are formed by operations imparting severe cold work hardening thereto, and including the step of subjecting said articles to a recrystallization anneal at a temperature of about 730° C for about 10 minutes, prior to said step of passing said articles through said fused nitriding salt bath.

* * * * *